United States Patent [19]

Kantner

[11] Patent Number: 4,596,122

[45] Date of Patent: Jun. 24, 1986

[54] SORPTION HEAT PUMP

[75] Inventor: Alexander Kantner, Remscheid, Fed. Rep. of Germany

[73] Assignee: Joh. Vaillant GmbH, Remscheid, Fed. Rep. of Germany

[21] Appl. No.: 429,787

[22] Filed: Sep. 30, 1982

[30] Foreign Application Priority Data

| | | | |
|---|---|---|---|
| Mar. 14, 1981 | [DE] | Fed. Rep. of Germany | 8107911 |
| Mar. 14, 1981 | [DE] | Fed. Rep. of Germany | 8107913 |
| Mar. 14, 1981 | [DE] | Fed. Rep. of Germany | 8107914 |

[51] Int. Cl.[4] ..... F25B 15/00

[52] U.S. Cl. ..... 62/141; 62/148; 62/238.3; 62/476

[58] Field of Search ..... 62/283.3, 141, 148, 62/476; 237/2 B

[56] References Cited

U.S. PATENT DOCUMENTS

| | | | |
|---|---|---|---|
| 2,850,266 | 9/1958 | Merrick et al. | 62/148 X |
| 3,837,174 | 9/1974 | Miyagi et al. | 62/148 X |
| 4,090,372 | 5/1978 | Lamb | 62/141 |
| 4,202,181 | 5/1980 | Lamb | 62/141 |
| 4,269,034 | 5/1981 | Rzechula | 62/141 |
| 4,322,951 | 4/1982 | Alfano | 62/141 X |
| 4,364,240 | 12/1982 | Schulz et al. | 62/476 |
| 4,394,959 | 7/1983 | de Vries | 62/238.3 X |
| 4,429,541 | 2/1984 | Kamejima et al. | 62/148 X |

FOREIGN PATENT DOCUMENTS

| | | | |
|---|---|---|---|
| 760945 | 3/1934 | France | 62/238.3 |

*Primary Examiner*—Lloyd L. King

*Attorney, Agent, or Firm*—Horst M. Kasper

[57] ABSTRACT

A system for controlling a sorption heat pump. Fuel is fed to a burner via a feed line and a fuel valve. The burner heats a generator containing a heat transfer fluid such as a mixture of water and ammonia and generates pressure inside the generator. The vapors produced by the heating are condensed in a condenser. The condensed heat transfer fluid vapors are throttled and passed into an evaporator. The output fluid from the evaporator is returned via an absorber to the generator. Heat is exchanged between the fluid and a circulating medium for a thermal use provision in the condenser and in the absorber. An intensive thermodynamic parameter such as pressure or temperature of the fluid in the pressurized section of the sorption heat pump is controlled depending on the heat requirements of the thermal use provision and/or the thermal input from the environment into the evaporator. The generator and condenser can be constructed as a joint unit preferably with an intermediate rectifying column. The depleted solution coming from the bottom of the generator and the evaporated refrigerant can be combined in the absorber to a solution rich in refrigerant. The rich solution can be fed back to the rectifying column and entered into the column at a level, where the composition of the rich solution corresponds to the composition of the fluid inside the column.

18 Claims, 3 Drawing Figures

SORPTION HEAT PUMP

CROSS-REFERENCE TO RELATED APPLICATIONS

This application is a continuation-in-part application of another application filed Jan. 18, 1982 and bearing Ser. No. DE/82/00043; of another application filed Jan. 18, 1982 and bearing Ser. No. DE/82/00044; and of another application file Jan. 18, 1982 and bearing Ser. No. DE/82/00059. This claim is made under Section 35 U.S.C. 365 (c) and under any other Section of the U.S.C. supporting such claim.

DESCRIPTION

BACKGROUND OF THE INVENTION

1. Field of the Invention

The present invention relates to a sorption heat pump and to a method of controlling a sorption heat pump comprising a generator heated by a burner, a condenser, a throttle valve, solvent recycling means, an evaporator and a thermal use provision.

2. Brief Description of the Background of the Invention Including Prior Art

Such sorption heat pumps can be absorption or resorption pumps and they are used increasingly to heat residential buildings. The sorption heat pumps are intended to replace hot water heaters, steam hot water and air heating systems employing for example boilers as heaters. The thermal use provisions of such heaters in general include floor heating, radiator heating and convection heating units, which are frequently provided with thermostat valves, as well as hot water tanks.

A number of sorption heat pumps have become known, which comprise a generator heated by a burner using a fluid fuel. A feed line for a solvent/refrigerant solution opens into the generator and refrigerant vapor can be withdrawn from the refrigerant and be conducted to a condenser. An outlet conduit for depleted solution is also provided.

The entire refrigerant vapor has to be supplied to the condenser according to such constructions and plants, or respectively the refrigerant vapor after condensation in the condenser is supplied from the condenser through an expansion valve to the evaporator. For instance, the ambient energy source feeding the evaporator, such as ambient air or surface water, may be at such a low temperature that the evaporator cannot evaporate the entire liquid refrigerant, which is supplied to the evaporator through the expansion valve. As a result, the evaporator becomes entirely filled with liquid refrigerant so that the cooled, liquid refrigerant finally enters the absorber and a heat pump operation is not any longer possible.

SUMMARY OF THE INVENTION

1. Purposes of the Invention

It is an object of the present invention to provide a controller for such a sorption heat pump, which reduces the use of primary energy into the generator to an absolute necessary minimuim depending on the heat energy requirements of the thermal use provision and which at the same time assures a sufficient passage of solvent and refrigerant in order to optimize the operation of the internal cycle of the heat pump.

It is another object of the present invention to provide an optimum coordination of the construction parts of generator and condenser such that the operation will be as optimal as possible and that these two parts can be manufactured at lowest possible costs.

It is a further object of the present invention to provide a system adapted to be responsive to changing requirements concerning heat production and thermal energy consumption.

These and other objects and advantages of the present invention will become evident from the description which follows.

2. Brief Description of the Invention

The present invention provides a method for controlling a sorption heat pump which comprises feeding fuel to a burner via a feed line containing a fuel valve, heating a generator containing a heat transfer fluid with the burner and thereby pressurizing the heat transfer fluid, condensing the vapors produced by the heating in a condenser, throttling the condensed heat transfer fluid vapors coming from the condenser, passing the throttled condensed fluid into an evaporator, returning the output fluid from the evaporator via an absorber to the generator, exchanging heat between fluid and a circulating medium for a thermal use provision in the condenser and absorber, and controlling an intensive thermodynamic parameter of the fluid in the pressurized section of the sorption heat pump depending on the heat requirements of the thermal use provision.

A physical parameter of a property of a material, which does not depend on the mass of the material, is called an intensive parameter corresponding to the property. Compare for example Warren H. Giedt, Thermophysics, Publisher: Van Nostrand Reinhold, New York, N.Y. 1971 or Gabriel Weinreich, Fundamental Thermodynamics, Addison Wesley Publishing Co., Reading, Mass. 1968.

The intensive thermodynamic parameter of the heat transfer fluid can be the pressure or the temperature of the fluid. The set point of the intensive thermodynamic parameter can be set depending on the environmental temperature on the outside, depending on the geothermal location of the sorption heat pump, or depending on the amount of heat transfer provided in the thermal use provision. Preferably, the controlled intensive thermodynamic parameter is determined from measurement of the temperature in the feed pipe and/or return pipe of the pipes going to the thermal use provision.

The manipulated variables in the control of the sorption heat pump can be the thermal power output of the burner and the flow speed of the circulating heat transfer fluid. Initially, the thermal output of the burner can be manipulated and the flow speed of the circulating heat transfer fluid can follow in being manipulated. The flow speed of the circulating heat transfer fluid can be adjusted after the deviation from the set point of the intensive thermodynamic parameter has reached a minimum or respectively zero. The flow speed of the heat transfer fluid may only then be adjusted if the gradient of the changing deviation from the set point has reached a maximum. Preferably, the intensive thermodynamic parameter is the pressure and/or temperature of the heat transfer fluid in the condenser. The flow speed can be adjusted only then when the filling level in the generator has reached and/or exceeded a limiting value.

Furthermore, the flow speed of the refrigerant part of the heat transfer fluid can be controlled relative to the flow speed of a solvent part of the heat transfer fluid. The flow speed of the refrigerant part of the heat transfer fluid can be controlled relative to flow speed of the solvent part of the heat transfer fluid depending on the thermal power transferred in the thermal use provision. In addition, the ratio of the flow speed of the refrigerant vapor part of the heat transfer fluid to the flow speed of the solvent part of the heat transfer fluid can be controlled depending on the temperature in the evaporator. The flow speed of the circulating medium passing the thermal use provision can be controlled depending on the thermal energy transferred by the thermal use provision. The flow speed of the circulating medium can be controlled via the rotary speed of an electric motor.

Furthermore, the temperature of the thermal source feeding the evaporator can be measured and determined and the flow speed of the refrigerant vapor part through the evaporator can be adjusted depending on the change in temperature of the heat source feeding the evaporator. The flow speed of the depleted solvent can be adjusted in parallel to the resetting of the flow speed of the refrigerant vapor part of the heat transfer fluid through the evaporator. An inverse relationship can be provided for the change of flow speed of depleted solution into the absorber with respect to the change of flow speed of the refrigerant vapor in the evaporator. Further, the flow speed of the refrigerant vapor part of the heat transfer fluid through the evaporator can be controlled depending on the temperature in the region of the evaporator.

The flow of the refrigerant part of the heat transfer fluid can be directed by a three-way valve disposed after the condenser into the direction of the refrigerant vapor pipe going to the evaporator or alternatively into the direction back to the generator as a feedback stream.

The temperature of the fluid output of the evaporator can be sensed and the sensed signal can be fed to a controller and thereby the cross-section of an expansion valve can be controlled with a final control element connected to the controller, which valve is prepositioned relative to the evaporator on the side of the refrigerant vapor. The level of the liquid in the interior of the evaporator can be sensed with a level sensor and the signal from the level sensor can be fed together with the signal of a temperature sensor sensing the fluid output of the evaporator to a controller for actuating a throttle valve for passing the refrigerant. In addition, the level of the liquid in the generator can be sensed and the signal from this level sensor can be fed together with a signal of a temperature sensor sensing the fluid output of the evaporator to a controller.

According to a preferred embodiment, the generator and the condenser can be joined into one single column. Also, the generator and the condenser can be enclosed in a joint container. The condenser can be connected to a thermal use provision by way of a feed pipe and of a return pipe and the condenser can be disposed as a pipe coil heat exchanger in the dome of a joint container. A condensate collector can be provided disposed below the condenser. A condensate pipe can be connected to the condensate collector, a three-way valve can be connected to the condensate pipe where the input and one output of the three-way valve effects a condensate feedback and which feedback connection can have a return opening into the interior of the casing above the uppermost overflow plate. A downward inclination can be provided to the condensate pipe coming from the three-way valve and going back to the generator for allowing gravity driven transport of the condensate to be returned. The condensate from the condensate collector can also be transported via an inclined pipe to the three-way valve.

In addition, a rectifying column can be provided between generator and condenser. Refrigerant rich solution can be fed via a pipe in the area of the rectifying column into the generator. Preferably, a shut-off valve and a feed line for rich solution is provided above each of overflow plates disposed in the rectifying column. Concentration sensors disposed abvove the overflow plates can be coordinated to a controller and additional second concentration sensors can be disposed in the area of the pipe feeding in the rich solution. In each case by way of the controller that valve can be opened which connects that pipe with that overflow plate, where the concentration level in the column corresponds most closely to the concentration of the solution inside the pipe.

A plurality of overflow plates can be disposed on top of each other in the rectifying column. Openings can be provided in the individual overflow plates, which openings are covered with a cover by way of leaving free an intermediate open slot. The individual overflow plates can be provided with horizontally disposed openings surrounded by upward rims and the openings can be covered with covers provided with downward rims opposed to the upward rims of the openings. The height of the upward rims can be larger than the slot which remains between the end of the rim and the corresponding downward rim of the cover. Furthermore, each overflow plate can be provided with an overflow pipe which starts at a distance above with respect to the overflow plate and which ends at a distance from the overflow plate disposed below the overflow plate. The distance of the overflow pipe from its top to the corresponding overflow plate can be larger than the distance between the edge of the downward rim of the cover and the overflow plate.

There is also provided a sorption heat pump which comprises a feed line for fuel connected to a fuel supply, a burner connected to the feed line for fuel, a generator disposed adjacent to the burner for receiving thermal energy from the burner, a condenser connected nearest the top to the generator for receiving refrigerant vapors from the generator, as throttle valve connected to the condenser for receiving condensed refrigerant vapors from the condenser, an evaporator connected to the throttle for receiving refrigerant from the throttle, an absorber connected to the evaporator for receiving evaporated refrigerant from the evaporator, means for returning refrigerant from the absorber to the generator, a sensor responding to an intensive thermodynamic parameter of the pressurized fluid and disposed in the pressurized section of the sorption heat pump, and a controller connected to the sensor for maintaining the intensive thermodynamic parameter of the pressurized fluid according to the setting of the set point of the intensive thermodynamic parameter.

There can be further provided a thermal use provision connected to the condenser for allowing transfer of thermal energy from the refrigerant vapors to the thermal use provision. A thermal use provision sensor can determine the amount of heat transfer in the thermal use provision and can be connected to the controller. A temperature sensor can be disposed in the feed pipe of the thermal use provision and can also be connected to the controller or a temperature sensor can be disposed in the return pipe of the thermal use provision and again be connected to the controller. Preferably, the sensor responding to an intensive thermodynamic parameter is a temperature or a pressure sensor.

Further, a temperature sensor can be furnished for measuring the outside temperature and can be connected to the controller to provide a setting of the set point of the intensive thermodynamic parameter. A final control element can be connected to the controller and can actuate the supply of fuel to the burner. A final control element can be connected to the controller and can actuate the circulation of heat transfer fluid through the generator. The controller can be a sequential controller in providing sequential signals to different final control elements and can actuate first the final control element supplying fuel to the burner and then secondly the final control element providing circulation of heat transfer fluid.

The sensor for the intensive thermodynamic parameter can be disposed in the condenser or in the generator. In addition, a level sensor can be disposed in the generator for ascertaining the position of the level of the liquid phase in the generator. Also, a temperature sensor can be disposed in the evaporator and then be connected to the controller.

A depleted solution pipe can connect the bottom of the generator to the absorber and a throttle valve can be disposed in the depleted solution pipe between generator and absorber.

A thermal use provision can be connected to the absorber for allowing transfer of thermal energy from the thermal transfer fluid to the thermal use provision. A valve can be provided adapted to a pulse-pause cycle and be disposed between generator and condenser and connected to the controller for allowing the pass-through of refrigerant vapor. A temperature sensor can be disposed near the evaporator for measuring the temperature of the thermal source feeding the evaporator and can be connected to the controller. A valve for controlling the flow speed of the refrigerant vapor of the fluid through the evaporator can be disposed in the refrigerant connection between condenser and evaporator and can be actuated by the controller depending on the temperature of the thermal source.

Preferably, the condenser is disposed above the generator. A condensate collector can be disposed between the condenser and the generator. A three-way valve can be connected to the condensate collector on the one hand and to the top of the generator and to the evaporator on the other hand. A final control element for the three-way valve can be connected to the controller for actuating the three-way valve. A downwardly inclined connection pipe can be disposed between condenser and three-way valve and another downwardly inclined connection pipe can be disposed between the three-way valve and the top of the generator.

A joint container can confine the generator and the condenser and a pipe coil heat exchanger can be disposed in the condenser. In addition, a rectifying column can be disposed between generator and condenser. A connection in the area of the rectifying column can provide a return pipe for the thermal transfer fluid coming from the absorber and a shut-off valve can be disposed in the connection.

Overflow plates can be disposed in the rectifying column. In order to allow the return of rich solution at different levels of the rectifying column valves can be disposed at inlets on various levels of the rectifying column. Concentration sensors can be disposed above the overflow plates for inducing actuation of a valve such that the return composition of the fluid corresponds to the concentration in the rectifying column at the same level.

Covers can be provided to cover horizontal openings in the overflow plates such that an open slot is left between the overflow plates and the covers. Upward rims can be disposed around the openings in the overflow plates and downward rims can be disposed around the covers and oppose the upward rims disposed around the openings. The height of the upward rim can be larger than the slot which remains between the end of the rim and the corresponding downward rim of the cover.

An overflow pipe can be provided for each overflow plate and the overflow pipe can start at a distance above the overflow plate and the overflow pipe can end below the overflow plate at a certain distance. The distance from the top of the overflow pipe to the corresponding overflow plate can be larger than the distance between the edge of the downward rim of the corresponding cover and the overflow plate.

A temperature sensor can be disposed between evaporator and absorber for determining the temperature of the thermal transfer fluid coming from the evaporator and connected to the controller. An expansion valve can be disposed in front of the evaporator and can be controlled by a final control element responding to the temperature sensor between evaporator and absorber.

Further, a liquid level sensor can be disposed in the evaporator and can be connected to the controller. An expansion valve can be disposed in front of the evaporator and can be actuated by a final control element connected to the controller and responding to the liquid level sensor.

The above described construction of having one container for the generator and the condenser provides the advantages that in the total region of generator and condenser the same pressure prevails such that upon providing a statically higher disposed position of the condenser versus the generator, there is made possible a reflux of the not required refrigerant condensate into the generator without the requirement of providing a special driving provision such as a pump action or the like to move the refrigerant condensate.

The novel features which are considered as characteristic for the invention are set forth in particular in the appended claims. The invention itself, however, both as to its construction and its mode of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

In accordance with the present invention there is provided a method for controlling a sorption heat pump with a generator, which is heated by a burner fed from a fuel feed line incorporating a fuel valve, also comprising a condenser, a throttle valve, solvent recycling means, an evaporator, a thermal use provision, which is connected in a cycle that is heated via heat exchangers which are associated with the condenser and an absorber. The pressure in the high pressure part of the sorption heat pump is used as a controlled variable and the heat demand by the thermal use provision is used as a disturbance variable. Alternatively, the temperature in the high pressure part of the sorption heat pump is used as a controlled variable and the heat demand by the thermal use provision is used as a disturbance variable. The variables manipulated upon occurrences of disturbances are primarily the feeding of fuel to the burner and thus the heat input to the generator and the flow speed of the thermal transfer fluid through the sorption heat pump.

The set point of the controlled variable can be varied in dependence on the outdoor temperature in conjuction with the climatic zone in which the heat pump is installed and the power output of the thermal use provision. The temperatures in the feed pipe and in the return pipe connected to the thermal use provision can be sensed to ascertain the disturbance variable.

In changing the manipulated variables, the burner output power can be changed first and the flow rate of the solution can be changed thereafter to effect a variation of the manipulated variables. The flow rate of the solution can be changed when the deviation from set point has reached a minimum or zero. Alternatively, the flow speed of the solution is not changed until the gradient of the changing deviation has reached a maximum. The pressure and/or temperature in the condenser can be used as a controlled variables.

Preferably, the flow rate of the solution fluid will not be changed until the liquid level in the generator has risen above or fallen below a limiting value. In addition, a control of the ratio of the flow rate of the refrigerant fluid to the flow rate of the solution fluid can be superimposed on the control method. This ratio can be varied depending on the thermal output of the thermal use provision. Furthermore, the ratio of the flow rate of the refrigerant vapor to the flow rate of the solution fluid can be varied in response to changes of the temperature in the evporator.

Figure 1:
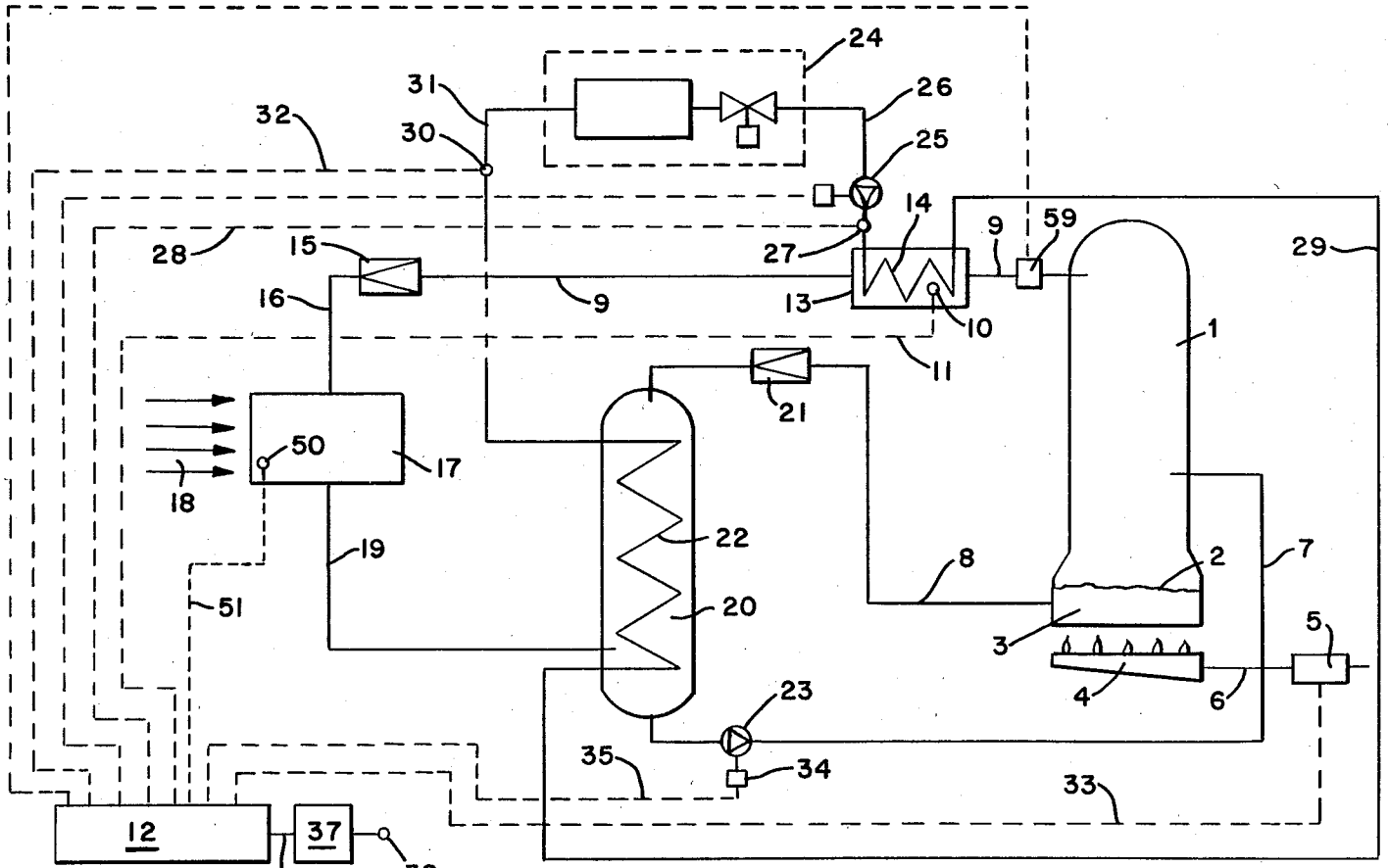
FIG. 1 is a view of a schematic diagram showing an absorption heat pump.

Referring now to FIG. 1 there is shown a generator or reboiler 1, which may be followed by a rectifying column, and which is filled to a level 2 with a solution 3 rich in refrigerant comprising ammonia vapor dissolved in water and which solution fluid is heated by a gas burner 4, which is fed via a gas conduit 6 provided with a solenoid valve 5.

A recycling conduit 7 supplies rich solution to the generator 1. Under the thermal heating with primary energy from the burner 4, the rich solution is separated into a depleted solution and refrigerant vapor, which is discharged via conduits 8 and 9, respectively. The high pressure part of the sorption pump is monitored by a pressure sensor 10, which according to an embodiment of the invention can alternatively or concurrently be a temperature sensor. This pressure sensor 10 may be disposed in the high pressure part of the sorption heat pump at any desired point, for example also in the condenser 13. The high pressure part extends from the expansion valve for the solvent 21 to the expansion valve for the refrigerant 15 and includes the reboiler 1 and the condenser 13. The sensor 10 is connected to a controller 12 by a signal line ll. A temperature sensor could be disposed in the reboiler 1 or in the condenser 13 or in the conduit 9 connecting the two. The refrigerant vapor conduit 9 leads to the condenser 13 and to the expansion valve 15, the output of which is connected with a conduit 16 to an evaporator 17. The evaporator 17 is in a conventional manner exposed to to an environmental energy source 18 such as for example air or water. A refrigerant vapor conduit 19 leads from the evaporator 17 to an absorber 20, the interior of which communicates through another expansion valve 21 for the depleted solution with the conduit 8. A pipe coil 22 is disposed in the interior of the absorber to provide heat exchange. The conduit 7 is provided with a circulating pump 23 capable of pumping against the pressure inside of the generator, which pump 23 is connected to the outlet of the absorber.

A thermal use provision 24, which can comprise a plurality of heating radiators disposed in parallel or in series, which are possibly in each case preceeded by a thermostat valve, and/or a hot water tank, is connected via a feed pipe 26 incorporating a circulating pump 25 to the pipe coil 14 of the condenser 13. The temperature in the fed pipe is sensed by a temperature sensor 27, which is connected to the controller 12 via a signal line 28. A conduit 29 leads from the pipe coil 14 to the pipe coil 22 of the absorber 20, from which a return pipe 31 provided with a temperature sensor 30 is connected to the controller 12 with a signal line 32.

The solenoid valve 5 for the fuel is connected by a control line 33 to the output of the controller 12. The pump 23 is driven by a motor 34, which is also connected to the output of the controller 12 via a control line 35.

A set point signal generator 37 is connected via a line 36 to the controller 12, and the set point signal generator in turn is connected to an outdoor temperature sensor 38.

The control method includes the following operations: It is first assumed that the outdoor temperature is constant such that the temperature sensor 38 delivers the same or almost the same signal during a certain time period, and similarly the temperature T0 of the environmental energy source 18 is also constant such that the evaporator 17 receives energy at a contant rate. As a result, the heat demand from the thermal use provision, in particular if it comprises radiators controlled by thermostat valves, will also be constant. This heat demand can be determined by the size of the feed line temperature, which is fed to the controller 12 from the temperature sensor 27 via the signal line 28. This may be supplemented by the detection of the feed pipe temperature, which is represented by the signal delivered from the return pipe temperature sensor 30 via the signal line 32 to the controller 12. In addition the setting of a mixing valve or the flow speed could be sensed and measured. Consequently, the thermal use provision 24 will extract by way of the heat exchanger pipe coils 14 and 22 heat at a certain rate from the refrigerant cycle of the sorption heat pump. This heating rate will substantially depend on the environmental outdoor temperature and on the location of the heat pump and may be estimated with the aid of so-called climatic zones into which the territory of the United States in divided according to the determinations of the Department of Agriculture or any other territory of other countries where the heat pump is installed. A predetermined heat demand curve can be impressed on the set point signal generator providing for a certain heat demand of the thermal use provision expressed in the values of the feed pipe and of the return pipe temperatures or respectively the temperature differences between them, such that under normal conditions the requirements of the thermal use provision will be met. In case of changing requirements, a changed set point should be set at the set point signal generator 37. Therefor, the desired value of pressure or temperature in the high pressure part of the heat pump is controlled depending on the location of installation of the sorption heat pump and on the prevailing outside temperature. Furthermore, the set point curve is adjusted according to the kind and possibly change of the heating system. It will be appreciated in view of these criteria that at a certain power input to the evaporator 17 energy at a certain rate has to be supplied by the burner 4 to the generator or reboiler 1 in order to attain the heat balance of the refrigerant cycle of the heat pump.

Similarly, the motor 34 of the pump 23 for circulating the solvent fluid must be controlled to ensure that the solution fluid will be circulated in accordance with the requirements of balancing heat input and heat output. It has been found that for a delivery of heat at a given rate to the thermal use provision a certain pressure in the high-pressure part of the heat pump or a certain temperature in the reboiler or condenser must be maintained if the rate at which primary energy is supplied to the heat pump from the burner 4 is to be minimized. For this reason, the pressure in the condenser is monitored by the pressure or temperature sensor 10, which delivers a corresponding signal to the controller 12. The pressure or, respectively, temperature in the condenser is compared with the respective set point to provide the deviation. The final control elements of the control system, that is the valve 5 and the pump motor 34, are adjusted to reduce the deviation to zero. It is contemplated to first adjust the fuel feed rate as a manipulated variable and then to adjust the transporting capacity of the solvent pump. In response to a drop of the pressure or temperature in the generator 1, the fuel feed rate and the rate at which rich solution is transported by the solven pump 23 are increased and vice versa.

The controller 12 is provided as a proprotional or a proportional-integral controller. A proportional control could be obtained by a gradual opening or closing of the fuel valve 5 or by an increase of the voltage applied to the solvent pump motor 34 in dependance on the size of the deviation. An integral control could be obtained if an actuating motor is associated with the fuel valve and is started when a deviation occurs and adjusts the valve as long as there is a deviation. An integral control of the motor 34 could be effected, for example, by a variable transformer, which is associated with the solvent pump motor 34 and has a wiper that is actuated by a motor, which is started at a constant speed in response to a deviation and which is not stopped until the deviation has decreased to zero.

At least one disturbing variable is applied by the thermal use provision to the feedback control system comprising the pressure or temperature sensor 10, the controller 12 and the final control elements 5 and 23. In case of a change of the heat demand by the thermal use provision such as for example by an increased opening or closing of one or several thermostat valves or when additional heat is demanded by the hot water tank, then the increased heat demand will result in a drop of the temperature or pressure in the condenser or vice versa. The disturbing variable will immediately be detected by the sensors 27 and 30 and corresponding signals are delivered to the controller 12. In case of a thermal use provision controlled by a thermostat valve, a higher heat demand means that a larger cross-section is provided to the flowing medium in front of the heating radiator, which in turn allows a larger amount of heating medium to pass through the radiator. This will result in a smaller temperature difference between the feed pipe medium and the return pipe medium. In case of hand valves the increased thermal demand results in a lower feed pipe medium temperature, which only after a while also pulls down the return temperature. In this case the flow pass-through remains constant. Also this process results in an increase in the temperature difference. If a hot water tank has to be recharged, the temperature in the feed pipe also decreases such that the temperature difference will increase. These results will be obtained regardless of whether the thermal use provision is directly connected via a feed pipe and a return pipe or if a mixer is provided. In case of employment of a mixer the increased thermal demand from the thermal use provision results in a throttling of the mixer by-pass section, which in the same way can be detected as a disturbing variable. An increased heat demand by the thermal use provision might also be met by a control of the transport capacity of the heat circulation pump 25 of the heating system. In that case the manipulated variable will be the change of the speed of the motor for the heat circulating pump 25. In any case, a higher heat demand will result in a deviation because the higher heat demand involves a drop of the temperature or pressure in the condenser. The deviation from the set point is opposed by the prior determination of the disturbing variable and by correspondingly increasing the burner power by further opening of the solenoid valve 5. The consequence of this control action is an increased energy feed into the generator such that the pressure and temperature in the condenser increase. The gradient of this increase or respectively the condenser temperature are delivered to the controller from sensor 10 via signal line 11 and upon approach of the control deviation to the value zero or upon passage of the value zero also the transport capacity of the solvent pump 23 is increased, for example by increasing the speed of rotation of the motor 34.

In case of a decrease in heat demand by the thermal use provision the detection of the disturbed variable and the adjustment of the final control elements will occur in the opposite direction.

The control system described above with the application of a disturbed variable measurement could be applied to the evaporator in the same way. This is due to the fact that a change in power input into the evaporator such as caused by a drop in outdoor temperature will have approximately the same effect as a higher heat demand by the thermal use provision. Therefor, a temperature sensor 50 associated with the evaporator might be used to measure the temperature in the evaporator and feed a corresponding signal via a signal line 51 to the controller 12 so that the heat input rate of the evaporator could be indirectly ascertained. That heat rate would then constitute the disturbed variable, which is applied to the controller. Whether the control method is performed in response to changes in the state of the thermal use provision and/or in the evaporator, it will be desirable to match the rate of flow of refrigerant through the expansion valve or through the evaporator with the power input of the evaporator and/or the power output from the thermal use provision. For this purpose a valve 59 could be provided in the refrigerant vapor pipe, which is intermittently opened with a pulse/no pulse ratio which will determine the refrigerant flow rate.

The above described method can be used advantageously, but the influences of the ambient environment energy supply are not considered in their relation to the sorption heat pump as much as would be desirable. In the following embodiment shown in FIG. 2, the thermal energy contents of the environmental energy source onto the evaporator is considered in more detail regarding temperature and speed of flow through the evaporator.

Accordingly the temperature at point 128 of the thermal energy source 127 feeding the evaporator 126 is measured and the through-put of refrigerant vapor through the evaporator 126 is adjusted according to a change in the temperature of the thermal source feeding the evaporator with energy. Preferably the flow of depleted solution is adjusted in parallel to an adjustment of the refrigerant vapor flow though the evaporator. The rate of flow of depleted solution to the absorber 136 is changed inversely relative to the change of the rate of flow of the refrigerant into the evaporator 126. The rate of flow of refrigerant into the evaporator can be additionally controlled in dependence on the temperature of the refrigerant vapor leaving the evaporator.

A three-way valve 115 is disposed behind the condenser 111 in the course of a refrigerant vapor conduit 120 to the evaporator 126 and one conduit 120 leads to the evaporator 126 and the other conduit 116 from the three-way valve leads back to the generator 101 for feedback of refrigerant condensate. A temperature sensor 130 can be provided downstream of the evaporator 126 and can be connected to a controller 125 for controlling by means of final control element 123 the flow cross-section of the expansion valve 122, which precedes the evaporator 126 in the refrigerant flow path.

A level sensor 133 can be provided in the interior of the evaporator 126, which in connection with the temperature sensor 130 provides signals to the controller 125. Further, a level sensor 108 can be provided in the interior 102 of the generator 101, which together with the temperature sensor 130 provides signals to the controller 125.

Figure 2:
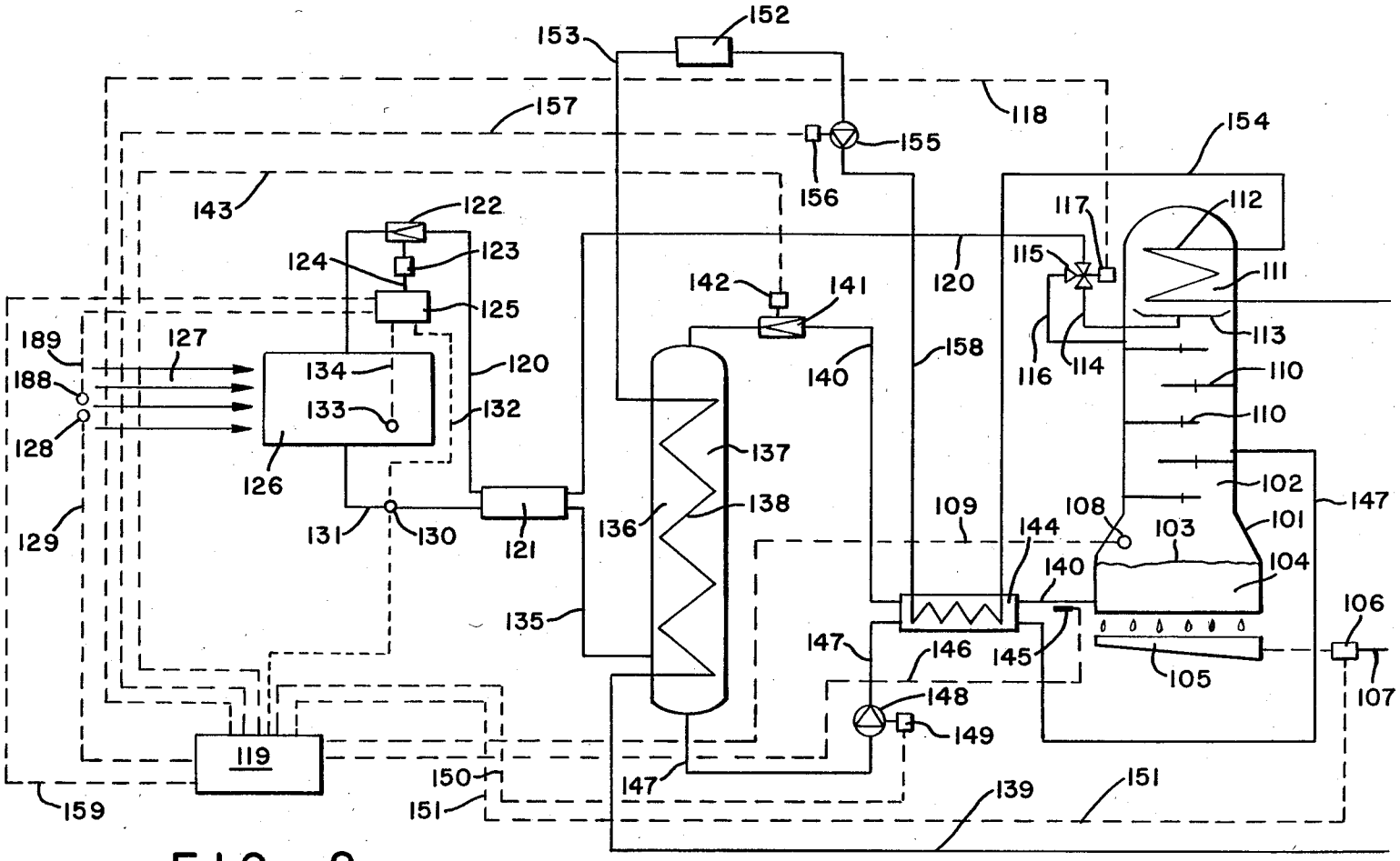
FIG. 2 is a view of another schematic diagram showing an absorption heat pump having additional features as compared to the absorption heat pump shown in FIG. 1.

Similarly as was illustrated by way of FIG. 1, there is also provided according to FIG. 2 a generator 101 having its interior space 102 filled with a depleted solution 4 of a mixture of ammonia and water up to a level 103. The generator is heated by a gas burner 105, which is supplied with fuel via a gas conduit 107, which incorporates a solenoid valve 106. A level sensor 108 protrudes into the interior 102 and is connected to a signal line 109.

The generator 101 contains overflow plates 110 in its intermediate region and its top portion contains a condenser 111, which comprises a heat exchanger pipe coil 112 disposed over a condensate collector bowl 113. A condensate conduit 114 runs from the condensate collector bowl 113 to a three-way valve 115, one connection of which runs back to the interior 102 of the generator 101 via a condensate feedback conduit 116. The condensate feedback conduit 116 opens above the top overflow plate 110 into the interior 102. The three-way valve 115 is provided with an actuating motor 117, which is connected via a control line 118 to a controller 119 for controlling the pressure or temperature in the high-pressure part of the sorption heat pump. Line 109 is also connected to the controller 119.

The second port of the three-way valve 115 is connected to a condensate conduit 120, which runs to a refrigerant heat exchanger 121. The condensate conduit 120 is provided with a pressure or temperature sensor not shown here for delivering signals to the controller 119. The conduit 120 continues beyond the refrigerant heat exchanger 121 and leads to an expansion valve 122, the controlled cross-section of which open to flow can be controlled by a final control element 123, which is connected via a line 124 to a flow controller 125. The expansion valve 122 is followed by an evaporator 126, which is operated with an ambient energy source 127 such as for example ambient air. The temperature of this environmental ambient energy source can be sensed by a temperature sensor 128, which is connected via a signal line 129 to the controller 119. Desirably, a sensor 188 disposed in parallel to the sensor 128 is disposed in the ambient energy source and connected via a line 189 to the flow controller 125. The air can be passed through the evaporator 126 via a blower and the air duct may incorporate a flow meter, which would be connected to the the controller 119 via a suitable signal line.

A refrigerant vapor conduit 131 leading to the refrigerant heat exchanger 121 is provided downstream of the evaporator 126 and the refrigerant vapor conduit 131 comprises a temperature sensor 130. The temperature sensor 130 is connected to the flow controller 125 via a line 132. Preferably, the flow controller 125 is also connected to the controller 119 via a cable 159. The sensor 130 or a separate comparable sensor is also connected to the controller 119. Another temperature sensor 188 may be provided adjacent to the evaporator 126 and may be exposed to air and can be connected via a line 189 to the flow controller 125.

The conduit 131 is continued beyond the refrigerant heat exchanger 121 by a refrigerant vapor conduit 135 leading to an absorber 136.

A heat exchanger pipe coil 138 passes through the interior space 137 of the absorber 136 and the heat exchanger pipe coil 138 is connected by a conduit 139 to the pipe coil 112.

A conduit 140 connected to the interior of the absorber incorporates an expansion valve 141, which is adapted to be controlled via an actuator 142 and a control line 143 by the controller 119. The conduit 140 passes through a heat exchanger 144 to the generator 101 and opens into the interior 102 of the generator 101 below the level 103 of the depleted solution. A temperature sensor 145 is attached to the conduit 140 and connected by a signal line 146 to the controller 119.

A conduit 147 for rich solution fluid is connected to the absorber 136 near its lower end and incorporates a circulating pump 148. The motor of the pump 148 can be controlled by a final control element 149 in order to vary the flow rate. The final control element 149 is connected to the controller 119 via a control line 150.

The conduit 147 runs beyond the pump 148 to the heat exchanger 144 and from there into a middle region of the height of the generator 101 above one of the overflow plates 110.

The solenoid valve 106 is also connected to the controller 119 via a line 151.

A thermal use provision 152 of the heat pump such as a floor heating system of a residential or commercial building or a heating system comprising radiators or convection devices or a hot water tank or a series or parallel connection of such apparatus can be connected with its return conduit 153 directly to a pipe coil 138 in the absorber 136. The heat exchanger pipe 112 is connected by a water conduit 154 to the heat exchanger 144, from where the feed conduit 158 provided with a circulating pump 155 feeds the thermal use provision 152. The motor of the circulating pump 155 is a final control element 156, which operates the pump 155 as desired regarding the volume of liquid to be transported. A control line 157 runs from the controller 119 to the final control element 156.

The region of the refrigerant vapor part from the interior space 102 of the generator 101 to the expansion valve 122 via the three-way valve 115 and the line 120 can be regarded as the high-pressure part of the plant. The high pressure part includes also the region which contains depleted solution and extends via conduit 140 and heat exchanger 144 to the expansion valve 141 for the solvent.

The heat pump described thus far including the means for controlling the heat pump operates as follows. It is first assumed that the outdoor temperature adjacent to the ambient energy source and the flow speed of the ambient energy source through the evaporator are constant such that the signal delivered by the temperature sensor 128 is constant or almost constant. Therefor, the evaporator receives continuously energy at a constant rate. Particularly, if the thermal use provision comprises rdiators controlled by thermostat valves, the heat demand of the thermal use provision will also be constant in that case. This heat demand can be ascertained from the temperature in the return pipe by a temperature sensor attached to conduit 153. This may be supplemented by a sensing of the temperature in the feed pipe for example by a sensor attached to conduit 158. The two temperature measurement values can be delivered to the controller 119 by way of signal lines. As the amount of heating medium is known based on the delivered volume and the rotation speed of the circulating pump 155, thus the amount of thermal energy can be determined, which is drawn by the thermal use provision. By means of the heat exchanges 138, 112, and 144, the thermal use provision 152 will draw a certain thermal energy from the refrigerant circle of the sorption heat pump. This quantity of thermal energy depends substantially on the outside temperature, the location of the heat pump and the demands of the thermal use provision, which for example may have to heat some space to a certain temperature. Information relating to the location can be obtained from climatic zone data. Therefor, one can determine a heat demand curve for the set point signal generator provided by controler 119. That curve can be expressed as the thermal energy demand of the thermal use provision by way of the feed pipe and return pipe temperatures or respectively their difference and the flow rate. In case of different temperature demands of the thermal use provision such as for example unusully high room temperature, a different set point would have to be adjusted in the set point providing unit of the controller 119. Thus the set point of the pressure in the high pressure part of the heat pump is maintained depending on the location of operation, the outside temperature and the desired room temperature or respectively the hot water temperature of a hot water tank. The pressure or respectively the temperature in the high pressure part of the heat pump can further be varied depending on the kind and possibly the kind of change of the type of heating system. For example, a hot water tank can be started to run in parallel to the heating system.

In view of these criteria it will be appreciated that it is important to feed a certain amount of thermal energy per unit of time to the generator or boiler 101 at a certain power input to the evaporator in order to maintain the heat balance of the refrigerant cycle of the heat pump. Similarly, the motor of the pump 148 for the solvent has to be set via the final control element 149 in order to assure that the solvent will be circulated in accordance with the thermal energy balance.

It has been found that for a certain thermal energy supply to the thermal use provision it is essential to maintain a certain pressure in the high pressure part of the heat pump or respectively a certain temperature in the boiler or respectively in the condenser in order to minimize the amount of primary energy fed to the burner 105. Thus the condenser pressure is surveilled and measured via a pressure or respectively temperature sensor in the high pressure part or respectively in the condenser or boiler and the sensed signal is transmitted to the controller 119. This condenser pressure or respectively the condenser temperature are compared with the set point, which is adjustable or respectively slidingly set for the set point signal generator of the controller 119. The deviation from set point results from the difference of condenser pressure and condenser temperature and, respectively, the set point, which difference is forced to zero by correspondingly adjusting the final control elements of the controller, in particular the final control element 149 and the gas solenoid valve 106. Here it is to be provided that initially the the solenoid valve 106 is adjusted to set the fuel flow rate and that then the flow rate of the solvent pump is adjusted. In case of falling pressure or respectively falling temperature in the boiler 101 the flow of fuel is initially increased and then the flow of rich solution through the solvent pump 148 is increased, and vice versa.

It is recognized that the controller for the heat pump results in a stationary state in case of a constant temperature condition in the environmental thermal energy source and of a constant situation of the thermal use provision.

This stationary state changes on the one hand upon a change of the conditions of the thermal use provision caused for example by a different desired room temperature or by an additional load of the heat pump caused by a parallel disposed hot water tank, which has to be reloaded after a bath. The steady state also gets out of balance if the temperature of the environmental thermal energy source or its flow speed through the evaporator change. For instance, if the heat pump plant is operating under steady-state conditions and the outdoor temperature TO of the outdoor air decreases while the state of the thermal use provision does not change for the time being, then this results in a corresponding decreasing signal of the sensor 128, which is delivered to the controller 119 via the signal line 129.

A decrease of the temperature in the stream of air 127 results in the feeding of a smaller energy stream from the environmental energy source to the evaporator 26, that is the passage of evaporated refrigerant through the conduit 131 decreases. However, initially unchanged amounts of liquid refrigerant are moved to the evaporator via the expansion valve 122 and via line 120, such that the liquid refrigerant is accumulated in the evaporator and its evaporation capacity will be further reduced. If the level sensor 133 disposed in the evaporator senses as increase in the amount of liquid refrigerant in the evaporator beyond a certain limit, then a corresponding signal is delivered via line 134 to the controller 125. At the same time there results a falling temperature in the refrigerant vapor conduit 131. The signal corresponding to the falling temperature is sensed by the temperature sensor 130 and fed to the controller 125 via line 132. It is now possible to set the cross-section of the expansion valve to an optimum value via the final control element 123 actuated by the controller 125 in order to maintain such a flow speed of the refrigerant through the evaporator 126 as to still evaporate without allowing the level of the refrigerant to rise.

It is further possible to adjust the passage cross-section of the expansion valve 122 in the section of the refrigerant vapor conduit 120 depending on the pressure and the temperature in the low pressure part of the sorption heat pump. The low pressure part of the heat pump comprises the refrigerant path from the outlet of the expansion valve 122 to the solvent pump and the solvent path from the outlet side of the expansion valve 141 similarly to the solvent pump.

In addition, it would also be possible to control the flow cross-section of the refrigerant expansion valve 122 as a function of the pressure and of the temperature in the high pressure part of the plant.

In case of a decrease of the temperature of the ambient thermal energy source, then initially the flow rate of the refrigerant into the evaporator will be adjusted by the feedback control system 130, 132, 133, 134, 125, 123, 122. A throttling of the the flow speed of the refrigerant vapor through the evaporator results in a retention of the liquid refrigerant in the conduit 120. This means that a control signal is delivered to the final control element 117 via line 118 from the difference temperature signal between the measurements of the sensors 128 and 130 in order to feed a larger part of the liquid refrigerant from the conduit 114 directly back into the reboiler 101 via conduit 116. Thus such an amount of liquid refrigerant is fed to conduit 120 as can be safely and continuously evaporated at the prevailing temperature and at a predetermined flow of the ambient energy source through the evaporator.

As the refrigerant passes finally through the absorber 136, a correspondingly changed amount of depleted solution per unit of time corresponds to a throttled passage of refrigerant. Thus after the level sensor 108 has responded there results also a set command from the control unit 119 via line 150 to the final control member 149 for increasing the flow speed of the solvent going through. By controlling of the two manipulated variables consisting of the refrigerant cycle flow speed and the solvent flow speed the controller 119 can maintain optimum operating conditions in the heat pump within a large range. If the temperature of the environmental air source falls too low or if the flow volume of the air through the evaporator decreases and it is not now possible to provide for a stationary state by actuating the control members 117 and 149, then in addition the expansion valve 141 is actuated via the final control member 142 in order to increase the flow of depleted solution fed to the absorber from the reboiler 101. Therefor, the throttling cross-section of the expansion valve 141 is increased. The change of the flow speed of the depleted solution through the absorber 136 is always inversely proportional to the change of the flow speed of the refrigerant vapor at a change in the temperature of the environmental energy source.

This kind of control operation can reach the point that upon a further decrease of the temperature of the ambient energy source the expansion valve can entirely shut off the supply of refrigerant into the evaporator. In this case the heat pump operates like a boiler in that only depleted solution is circulated through the absorber and the heat exchanger 144.

In case of an increase of the temperature of the outside environment the heat pump plant operates in the opposite direction.

It is the function of the generator 101 to heat the amount of solution 104 with the thermal energy from the gas burner 105 such that the refrigerant is evaporated. The refrigerant vapor escapes at the top and condenses on the heat exchanger coil 112 of the condenser 111. Liquid refrigerant drips into the condensate collector bowl 113 and is withdrawn via conduit 114. Refrigerant which is not required is returned to the condensate conduit 116 under control of the continuously adjustable three-way valve 115 set to an intermediate position and the refrigerant then flows down from stage to stage on the overflow plates 110. Refrigerant is evaporated and is entrained by the rising vapors. The lower the considered region of the generator 101 the higher is the content of the fluid in solvent. Close to the bottom or respectively to the junction point of the conduit 140 there is present the lowest refrigerant content of the depleted solution.

The heat pump is connected on the side of the thermal use provision such that the circulating medium of the thermal use provision is first heated in the absorber and then in the condenser. The last heating stage is provided in the region of the heat exchangers 144. By way of this construction it is on the one hand possible to ensure a maximum of the feed pipe temperature of the medium going to the thermal use provision and on the other hand the achievable final temperatures of the thermal use provision medium are adapted to the temperature situation in the heat pump plant.

If the thermal use provision 152 is subjected to changed heat demand conditions independent from changes of the temperature of the environment, then the controller 119 provides control signals to the gas solenoid valve 106, to the motor of the solvent pump and to the heating medium circulating pump 155. An increased demand of heat by the thermal use provision is coordinated to a larger flow speed of the fuel to the burner 105 and at the same time a larger throughput of heating medium through the thermal use provision 152. Independent, if the disturbance of the steady state is caused by the thermal use provision or by a change in the energy content of the environmental source, the controlled variable is always the pressure or the temperature in the high pressure part of the heat pump plant. This part comprises starting at the expansion valve 141, the conduit 140, the reboiler 101, and the line 120 to the expansion valve 122.

Figure 3:
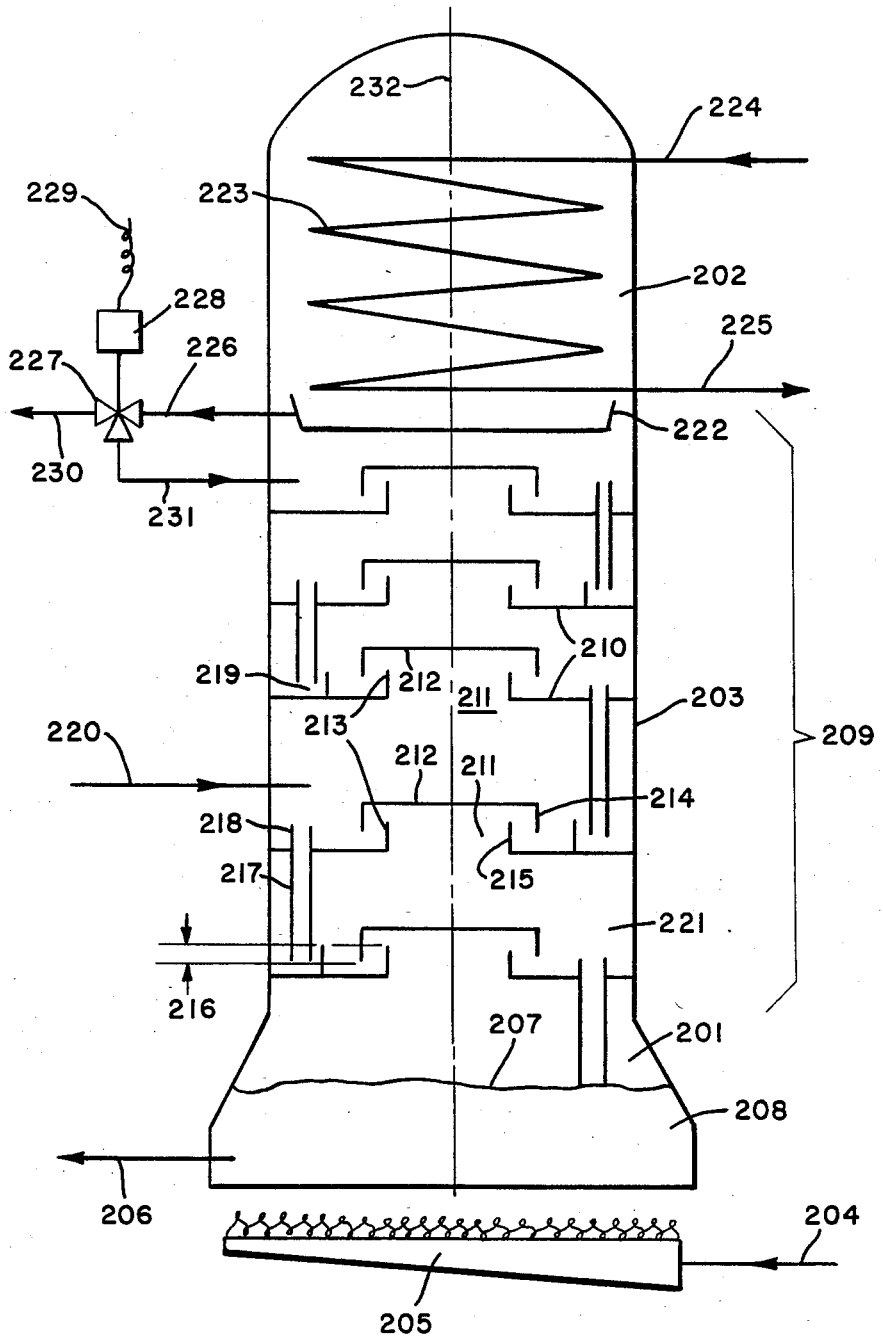
FIG. 3 is a view of a schematic diagram of a cross-section showing a unit comprising a generator and a condenser.

According to a preferred embodiment of the present invention the generator 201 and the condenser 202 form a joint column and/or joint casing 203 as shown in FIG. 3. The condenser 202 can be provided as a pipe coil heat exchanger 223 disposed in the dome 232 of the joint casing 203 and the pipe coil heat exchanger 223 can be connected to the return pipe 224 and to the feed pipe 225 of the thermal use provision. A condensate collector provision 222 can be provided below the condenser 202.

A rectification column 209 can be disposed between the generator 201 and the condenser 202. The rectifier can comprise a plurality of overflow plates 210 disposed sequentially on top of each other. The individual overflow plates 210 can be provided with recesses 211, which are covered by a cover 212 while leaving open a slot 213. The overflow plates 210 can be provided with upward directed edge rims 215 adjacent to the openings 211 and the covers 212 can be provided with edge rims 214, which extend oppositely to the upwardly directed edge rims 215 of the overflow plates 210. The height of the upwardly directed edge rims 215 can be larger than the slot, which remains between the edge of the rim and the corresponding overflow plate.

Each overflow plate 210 can be provided with an overflow pipe 217, which starts out at a distance 218 from the overflow plate 210 and which ends at a distance from the overflow plate 210 disposed below. The distance 218 of the overflow pipe 217 from the corresponding overflow plate 210 can be provided larger than the distance between the edge 214 and the corresponding overflow plate 210.

A condensate conduit 226 can be connected to the condensate collector provision 222 and can lead to the three-way valve 227. The input and one output of the three-way valve 227 can feed a condensate return conduit 231, which connects to the inner space 221 of the casing 203 above the uppermost overflow plate 210. A feed conduit 220 for rich solution can connect to the generator in the region of the rectification column 209. Preferably, above each of the overflow plates there is provided a connection for the conduit 220 with a shut off valve.

A controller can be provided to which are coordinated concentration gradient measurement sensors located above the overflow plates 210. An additional concentration mesurement sensor can be disposed in the region of the conduit 220 and the controller can open that valve, which connects the conduit 220 to that overflow plate 210, the solution of which has a concentration degree corresponding most closely to the concentration degree of the solution disposed inside of the conduit 220. The condensate removal conduit 226 can be provided with a slope for allowing the condensate to flow off. The discarding condensate conduit 230 from the three-way valve 227 to the top of the uppermost overflow plate can be sloped downward to the generator casing.

Referring to FIG. 3 there is shown the combination of a generator or boiler 201 and of a condenser 202 provided in a unified casing 203, where the condenser 202 is disposed above the generator 201. The generator 201 is heated with a burner 205 fed from a fuel supply line 204 and a conduit 206 is provided for removing depleted solution 206 from the generator 201. Depleted solution is found in the generator 201 up to a level 207 in the lowermost region. A rectifying zone 209 comprising several overflow plates 210 is disposed above the generator 201 between the generator 201 and the condenser 202. The overflow plates 210 are provided with central openings 211, which are covered with a cover 212, which defines annular gaps 213. The covers 212 are provided with downwardly directed rims 214 and the edges of the central openings 211 are provided with upwardly directed rim areas 215. The dimensions are selected such that the edge region 215 reaches by a distance 216 higher than the rim region 214. Each overflow plate 210 is provide in a lateral portion with an overflow tube 217, which starts at a distance 218 above the overflow plate 210, which runs through the overflow plate 210, and which ends at a distance 219 from the lower disposed overflow plate. The distance 218 is selected to be smaller than the height of the edge portion 215 and smaller than the distance from the edge portion 214 to the lower plate. It is apparent that the upper sides of two immediately adjacent overflow plates on top of each other are connected by the individual overflow tubes 217.

Furthermore, a plurality of overflow plates can be provided depending on the purity desired for the solution on the one hand and for the refrigerant vapor on the other hand. It is essential that a conduit 220 for supplying rich solution is provided in an intermediate region so that rich solution is provided to the interior 221 of the casing 203, for example by way of a solvent pump. The level of the connection of the conduit 220 can be varied in this situation by providing for example above of several of the overflow plates 210 connection possibilities for the conduit 210, which in each case can be closed by way of valves. Then one or the other of the valves can be chosen. The selection of the valve, where the feed of the rich solution is provided, depends then on the concentration of the rich solution in each case. The less refrigerant vapor is contained in the rich solution, the lower one selects the level of the connection of the feed conduit. Thus for example it is possible to provide at each overflow plate a concentration sensor for determining the concentration of the rich solution in refrigerant and to provide the inlet for the feed conduit 220 in each case at the level of that overflow plate by opening of the corresponding valve, which substantially corresponds in level to the same actual concentration level inside the column.

A condensate collector provision 222 is provided above the uppermost overflow plate, which collector provision is disposed immediately below of a heat exchanger pipe coil 223, which marks the region of the condenser 202 within the casing 203. The heat exchanger pipe coil 223 is connected to a supply conduit 225 through which a medium to be heated is conducted. This medium to be heated preferably represents the medium flowing through the thermal use provision of the sorption heat pump, which thermal use provision can be a heating installation. Condensate collected by the collector 222 my be discharged under the force of gravity through a condensate conduit 226 to a three-way valve 227, which valve is controlled by an actuator 228, which can be fed with continuously acting control signals via a control signal line 229 from a controller not shown in FIG. 3. A condensate conduit 230 runs from the three-way valve to an expansion valve and to the evaporator of the heat pump, while the condensate return conduit 231 is led with a drop in level to the interior space 221 of the casing 203, and in particular to a level above the first overflow plate.

The described generator-rectifier-condenser combination operates as follows. During operation of the respective heat pump plant the burner 205 is supplied with oil through the fuel supply conduit 204. The burner 205 heats the underside of the casing 203 such that a solution 208 present in the casing is boiled. Preferably, the refrigerant employed is ammonia and the preferred solvent is water. Here the ammonia has a considerably lower boiling point as compared with water. Upon boiling of the solution 208 therefor preferably refrigerant vapor is released, which however entrains vaporized solvent. The mixture of the two vapors passes the lowest central opening 221 to a level above the first overflow plate 210. Since the edge rim 215 extends above the lower edge rim 214 in the direction of the axis of symmetry 232 of the cylindrical casing 203, the vapor mixture must pass in the annular gap 213 through the solution which is present there. This solution is present above each overflow plate 210 since rich solution is provided by the conduit 220. Depleted solution is withdrawn from the lower portion below the level 207 through the conduit 206 by the solvent pump, not shown here. Since based on the boiling process continuously more refrigerant vapor is evaporated from the solution 208 as compared with the water, the solution gets depleted in refrigerant such that in comparision with the solution fed in via conduit 220 one can call the solution a depleted solution. As the vapor bubbles through the layer of liquid in each case above each overflow plate 210, solvent vapor is preferably condensed by the solution because the temperature in the casing 203 drops in an upward direction from overflow plate to overflow plate, whereas refrigerant vapor is preferentially left uncondensed as a result of the decreasing temperatures upon passing upward in the column. As a result, the concentration of refrigerant vapor in the liquid on the top of the overflow plates 210 increases from stage to stage or from overflow plate to overflow plate with increasing distance from the level 207 as the distance from the level 207 increases. For instance, the ratio of refrigerant vapor to solvent is about 65% to 35% by volume just after leaving of the level 207, this ratio changes to 80% to 20% after passing of the first overflow plate. Above the last plate a degree of concentration of nearly 97 volume percent in favor of the refrigerant vapor can be achieved. It follows therefrom that the refrigerant vapor passes away from the level 207 upwardly through the individual overflow plates and thereby increases in its purity. The driving power for the upward motion is the expelled vapor mixture from the boiling solution, which tends to rise and provide pressure.

As has been described, preferably the solvent condenses on each plate such that the level of the liquid on the individual plates rises until in each case the level 218 has been surpassed. After surpassing of the level 218 the solvent flows from the upper plate in each case to the lower plate. Thus under stationary steady state conditions of operation there is a continuous upward stream of refrigerant vapor, which encounters a counter current of a continuous downward stream of solution. While the degree of purity of the refrigerant vapor increases further away from the boiler, the degree of purity of the solvent increases in the direction toward the boiler.

The vaporized refrigerant passes into the area of the condenser 202 after leaving the uppermost overflow plate and passing the annular slot between the condensate collector provision 222 and the inner jacket of the casing 203. Based on the cooling effect of the pipe coil 223 the refrigerant condenses and drops into the condensate collector provision 222, from where it is led based on the draining by gravity forces via the condensate conduit 226. A more or less large part of the liquid condensate is fed via conduit 231 to the uppermost overflow plate depending on the intermediate position of the control member 228 selected in accordance with the momentary state of the plant, the demand coming from the thermal use provision as well as the temperature of the environmental energy source. The other part passes via conduit 230 via the expansion valve into the evaporator, is evaporated there, is joined with the depleted solution and fed away via conduit 206 in the area of the absorber not shown in FIG. 3, is absorbed and is fed again to the interior space 221 of the generator-rectifier by way of the solvent pump via conduit 220.

Thus it can be recognized from the above description that the complete inner space 221 from the area of the boiler 201 to the upper region of the condenser 202 is subjected to the same internal pressure. Depending on the heating power provided by the burner 205 pressures from about 14 to 25 bar can be obtained in the inner space 221. The temperatures in the area of the boiler 201 can vary from about 120 degrees centigrade to about 180 degrees centigrade, while in the area of the condenser temperatures of from about 45 to 60 degrees centigrade are possible. The refrigerant carried by conduit 230 has a temperature of about 40 to 50 degrees centigrade. The temperatures in the area of the rectifying column can range from a minimum of about 70 degrees centigrade to a maximum of about 120 degrees centigrade as distributed over the region from top to bottom.

It will be understood that each of the elements described above, or two or more together, may also find a useful application in other types of system configurations and heat pumping and refrigeration providing procedures differing from the types described above.

While the invention has been illustrated and described as embodied in the context of a sorption heat pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for controlling a sorption heat pump comprising feeding fuel to a burner via a feed line comprising a fuel valve;

heating a generator containing a heat transfer fluid with the burner and thereby pressurizing the heat transfer fluid; condensing the vapors produced by the heating in a condenser;

throttling the condensed heat transfer fluid vapors coming from the condenser;

passing the throttled condensed fluid into an evaporator;

returning the output fluid from the evaporator via an absorber to the generator;

exchanging heat between fluid and a circulating medium for a thermal use provision in the condenser and absorber;

controlling an intensive thermodynamic parameter of the fluid in the pressurized section of the sorption heat pump depending on the heat requirements of the thermal use provision;

determining the temperature of a natural thermal source feeding the evaporator; and adjusting the flow speed of the refrigerant vapor part through the evaporator depending on the change in temperature of the natural thermal source feeding the evaporator.

2. The method for controlling a sorption heat pump according to claim 1 further comprising providing an inverse relationship for the change of flow speed of heat transfer fluid depleted in refrigerant into the absorber with respect to the change of the flow speed of the refrigerant vapor in the evaporator.

3. The method for controlling a sorption heat pump according to claim 1 further comprising directing the flow of the refrigerant part of the heat transfer fluid by a three-way valve disposed after the condenser into the direction of the refrigerant vapor pipe going to the evaporator or alternatively into the direction back to the generator.

4. The method for controlling a sorption heat pump according to claim 1 further comprising sensing the temperature of the fluid output of the evaporator;

feeding the sensed signal to a controller; and controlling the cross-section of an expansion valve with a final control element connected to the controller, which valve is predisposed to the evaporator on the side of the refrigerant vapor.

5. The method for controlling a sorption heat pump according to claim 1 further comprising sensing the level of the liquid in the interior of the evaporator with a level sensor; and feeding the signal from the level sensor together with the signal of a temperature sensor sensing the fluid output of the evaporator to a controller for actuating a throttle valve for the refrigerant.

6. The method for controlling a sorption heat pump according to claim 1 further comprising adjusting in parallel to the resetting of the flow speed of the refrigerant vapor of the heat transfer fluid through the evaporator also the flow speed of the heat transfer fluid depleted of refrigerant.

7. The method for controlling a sorption heat pump according to claim 1 further comprising controlling the flow speed of the refrigerant vapor part of the heat transfer fluid through the evaporator depending on the temperature in the region of the evaporator.

8. The method for controlling a sorption heat pump according to claim 1 further comprising sensing the level of liquid in the generator; and feeding the signal from the level sensor together with a signal of a temperature sensor sensing the fluid output of the evaporator to a controller.

9. A method for controlling a sorption heat pump comprising feeding fuel to a burner via a feed line comprising a fuel valve;

heating a generator containing a heat transfer fluid with the burner and thereby pressurizing the heat transfer fluid; condensing the vapors produced by the heating in a condenser;

throttling the condensed heat transfer fluid vapors coming from the condenser;

passing the throttled condensed fluid into an evaporator;

returning the output fluid from the evaporator via an absorber to the generator;

exchanging heat between fluid and a circulating medium for a thermal use provision in the condenser and absorber;

controlling an intensive thermodynamic parameter of the fluid in the pressurized section of the sorption heat pump depending on the heat requirements of the thermal use provision;

joining the generator and the condenser into one single column;

providing the generator and the condenser in a joint container;

connecting the condenser by way of a feed pipe and of a return pipe to a thermal use provision;

disposing the condenser as pipe coil heat exchanger in the dome of the joint container;

providing a condensate collector below the condenser;

connecting a condensate pipe to the condensate collector;

connecting a three-way valve to the condensate pipe where the input and one output of the three-way valve effects a condensate feedback and feedback connection which has a return opening into the interior of the casing above the uppermost overflow plate.

10. The method for controlling a sorption heat pump according to claim 9 further comprising providing a downward inclination to the condensate pipe coming from the three-way valve and going back to the generator for allowing gravity transport of the condensate to be returned.

11. The method for controlling a sorption heat pump according to claim 9 further comprising removing the condensate via an inclined pipe from the condenser to the three-way valve.

12. A method for controlling a sorption heat pump comprising feeding fuel to a burner via a feed line comprising a fuel valve;

heating a generator containing a heat transfer fluid with the burner and thereby pressurizing the heat transfer fluid;

condensing the vapors produced by the heating in a condenser;

throttling the condensed heat transfer fluid vapors coming from the condenser;

passing the throttled condensed fluid into an evaporator;

returning the output fluid from the evaporator via an absorber to the generator;

exchanging heat between fluid and a circulating medium for a thermal use provision in the condenser and absorber;

controlling an intensive thermodynamic parameter of the fluid in the pressurized section of the sorption heat pump depending on the heat requirements of the thermal use provision;

joining the generator and the condenser into one single column;

providing a rectifying column between generator and condenser;

feeding via a pipe a solution rich in refrigerant into the generator in the area of the rectifying column;

providing a shut-off valve and a feed line for the solution rich in refrigerant above each of the overflow plates disposed in the rectifying column;

coordinating concentration sensors disposed above the overflow plates to a controller;

providing second concentration sensors in the area of the pipe feeding in the rich solution;

opening in each case by way of the controller that valve which connects the pipe with that overflow plate, where the concentration of the level in the column corresponds most closely to the concentration of the solution inside of the pipe.

13. The method for controlling a sorption heat pump according to claim 12 further comprising disposing a plurality of over flow plates on top of each other in the rectifying column.

14. The method for controlling a sorption heat pump according to claim 13 further comprising providing openings in the individual overflow plates, which openings are covered with a cover by way of leaving free an open slot.

15. The method for controlling a sorption heat pump according to claim 14 wherein the individual overflow plates are provided with horizontally disposed openings surrounded by upward rims and the openings are covered with covers provided with downward rims opposed to the upward rims of the openings.

16. The method for controlling a sorption heat pump according to claim 14 wherein the height of the upward rim is larger than the slot which remains between the end of the rim and the corresponding downward rim of the cover.

17. The method for controlling a sorption heat pump according to claim 13 wherein each overflow plate is provided with an over flow pipe which starts at a distance above with respect to the overflow plate and which ends at a distance from the overflow plate disposed below.

18. The method for controlling a sorption heat pump according to claim 17 wherein the distance of the overflow pipe from its top to the corresponding over flow plate is larger than the distance between the edge of the downward rim of the cover and the overflow plate.

* * * * *